United States Patent [19]

Abe et al.

[11] Patent Number: 4,644,920

[45] Date of Patent: Feb. 24, 1987

[54] LEARNING CONTROL SYSTEM FOR CONTROLLING AN AUTOMOTIVE ENGINE

[75] Inventors: Kunihiro Abe, Higashimurayama; Yoshitake Matsumura, Hachiouji; Takurou Morozumi, Mitaka, all of Japan

[73] Assignee: Fuji Jukogyo Kabushiki Kaisha, Tokyo, Japan

[21] Appl. No.: 757,545

[22] Filed: Jul. 19, 1985

[30] Foreign Application Priority Data

Jul. 20, 1984 [JP] Japan ..... 59-151777

[51] Int. Cl.[4] ..... F02D 41/14

[52] U.S. Cl. ..... 123/479; 123/486

[58] Field of Search ..... 123/486, 480, 416, 417, 123/479; 364/431.01, 431.03, 431.04, 431.05, 431.11

[56] References Cited

U.S. PATENT DOCUMENTS 4,309,971 1/1982 Chiesa et al. ..... 123/480

4,345,561 8/1982 Kondo et al. ..... 364/431.04

*Primary Examiner*—Andrew M. Dolinar

*Attorney, Agent, or Firm*—Martin A. Farber

[57] ABSTRACT

A system for updating data stored in a table at a steady state of engine operation in accordance with a feedback signal. When the difference between a maximum value and a minimum value of data stored in the table exceeds a predetermined limit, all the data is rewritten with a predetermined fail safe signal.

5 Claims, 11 Drawing Figures

LEARNING CONTROL SYSTEM FOR CONTROLLING AN AUTOMOTIVE ENGINE

BACKGROUND OF THE INVENTION

The present invention relates to a system for controlling the operation of an automotive engine, and more particularly to a learning control system for updating data stored in a table for the learning control.

In a learning control system, updating of data is performed with new data obtained during the steady state of engine operation. Accordingly, means for determining whether the engine operation is in the steady state is necessary. A conventional learning control system (for example U.S. Pat. No. 4,309,971) has a matrix (two-dimensional lattice) comprising a plurality of divisions, each representing engine operating variables such as engine speed and engine load. When the variables continue for a predetermined period of time in one of the divisions, it is determined that the engine is in steady state. On the other hand, a three-dimensional look-up table is provided in which a matrix coincides with the matrix for determining the steady state. Data in the look-up table is updated with new data obtained during steady state.

In such a system, if a sensor for obtaining information for updating data deteriorates and fails to produce a proper output signal, old data is rewritten by improper data. In case of a learning control system for controlling the air-fuel ratio of an air fuel mixture for a motor vehicle, an $O_2$-sensor is employed for obtaining information. If the $O_2$-sensor does not produce a proper output signal, the driveability of the vehicle decreases and fuel consumption increases.

SUMMARY OF THE INVENTION

The object of the present invention is to provide a system which may eliminate problems caused by the failure of a sensor.

In the system of the present invention, the failure of a sensor is determined by the condition that the difference between a maximum value and minimum value of data in a look-up table exceeds a predetermined limit value. When the failure is detected, all of the data in the table are rewritten with a predetermined fail safe value.

According to the present invention, there is provided a system for controlling an automotive engine by updated data, comprising, a table storing data used for controlling the operation of the engine, first means for detecting the operating condition of the engine and for producing a feedback signal dependent on the condition, and second means for updating the data in the table with a value relative to the feedback signal when steady state of the engine operation is detected. In the system, the difference between a maximum value and a minimum value of the updated data in the table is looked up. When the difference exceeds a predetermined limit value, all the data in the table is rewritten with a predetermined fail safe value.

The other objects and features of this invention will become understood from the following description with reference to the accompanying drawings.

DETAILED DESCRIPTION OF THE PREFERRED EMBODIMENT

Figure 1:
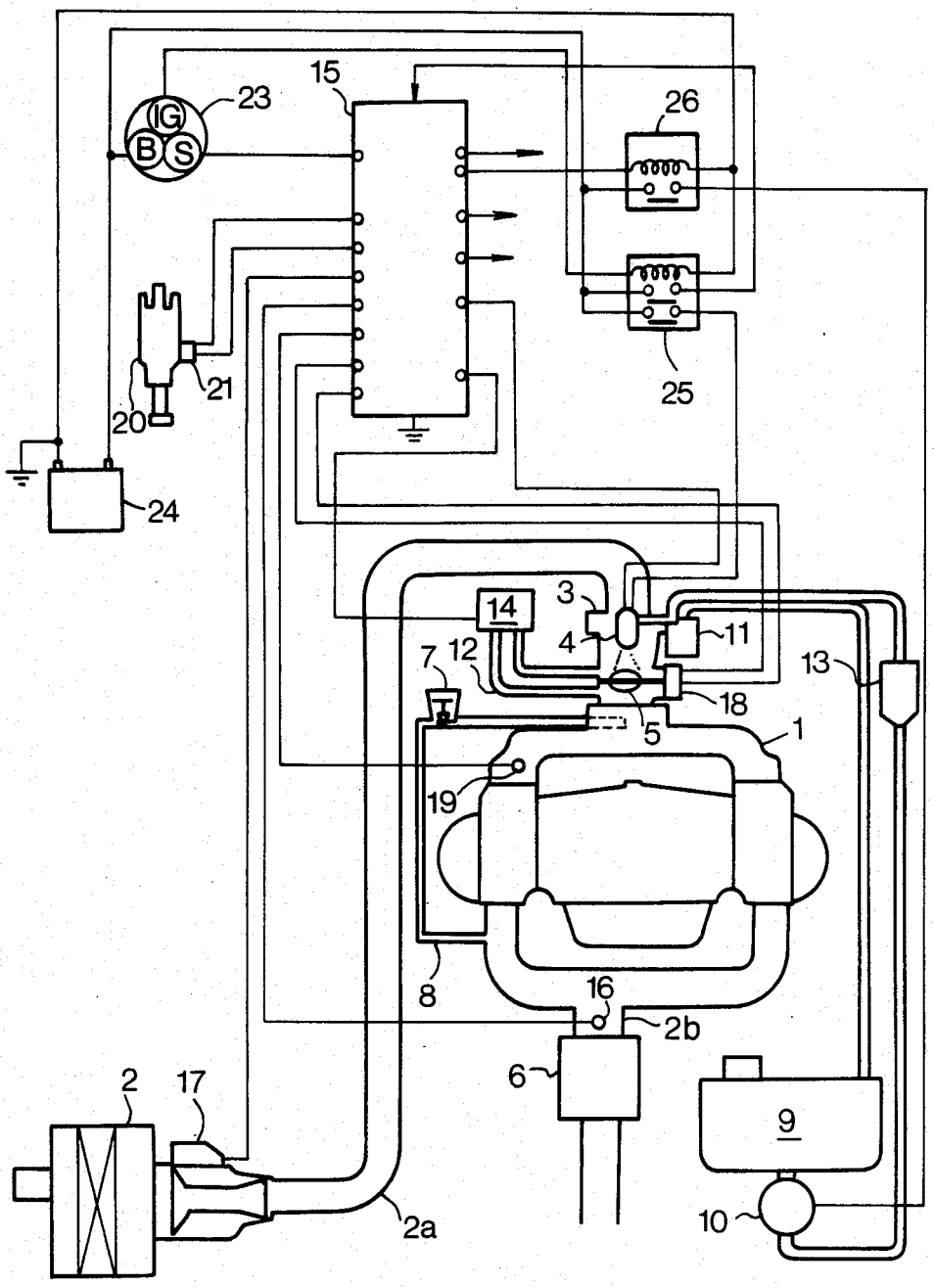
FIG. 1 is a schematic illustration showing a system for controlling the operation of an internal combustion engine for a motor vehicle.

Referring to FIG. 1, an internal combustion engine 1 for a motor vehicle is supplied with air through an air cleaner 2, intake pipe 2*a*, and throttle valve 5 in a throttle body 3, mixing with fuel injected from an injector 4. A three-way catalitic converter 6 and an $O_2$-sensor 16 are provided in an exhaust passage 2*b*. An exhaust gas recirculation (EGR) valve 7 is provided in an EGR passage 8 in a well-known manner.

Fuel in a fuel tank 9 is supplied to the injector 4 by a fuel pump 10 through a filter 13 and pressure regulator 11. A solenoid-operated valve 14 is provided in a bypass 12 around the throttle valve 5 so as to control engine speed at idling operation. A mass air flow meter 17 is provided on the intake pipe 2*a* and a throttle position sensor 18 is provided on the throttle body 3. A coolant temperature sensor 19 is mounted on the engine. Output signals of the meter 17 and sensors 18 and 19 are applied to a microcomputer 15. The microcomputer 15 is also applied with a crankangle signal from a crankangle sensor 21 mounted on a distributor 20 and a starter signal from a starter switch 23 which operates to turn electric current from a battery 24 on and off. The system is further provided with an injector relay 25 and a fuel pump relay 26 for operating the injector 4 and fuel pump 10.

Figure 2:
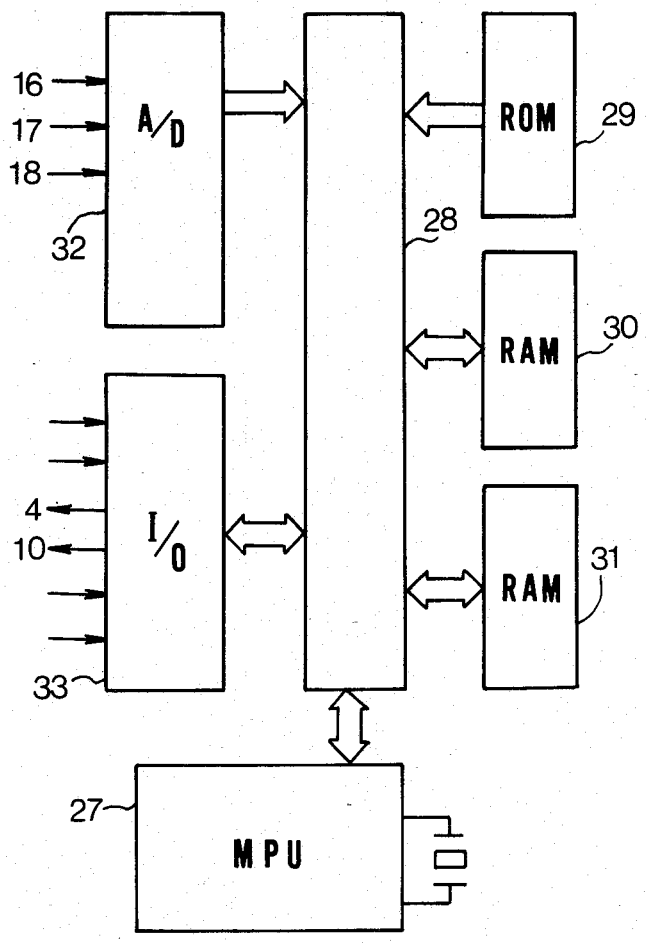
FIG. 2 is a block diagram of a microcomputer system used in a system of the present invention.

Referring to FIG. 2, the microcomputer 15 comprises a microprocessor unit 27, ROM 29, RAM 30, RAM 31 with back-up, A/D converter 32 and I/O interface 33. Output signals of the $O_2$-sensor 16, mass air flow meter 17 and throttle position sensor 18 are converted to digital signals and applied to the microprocessor unit 27 through a bus 28. Other signals are applied to the microprocessor unit 27 through I/O interface 33. The microprocessor manipulates the input signals and executes the hereinafter described process.

In the system, the amount of fuel to be injected by the injector 4 is determined in accordance with engine operating variables such as mass air flow, engine speed and engine load. The amount of fuel is determined by a fuel injector energization time (injection pulse width). Basic injection pulse width ($T_p$) can be obtained by the following formula.

$$T_p = K \times Q/N \quad (1)$$

where Q is mass air flow, N is engine speed, and K is a constant.

Desired injection pulse width ($T_i$) is obtained by correcting the basic injection pulse ($T_p$) with engine operating variables. The following is an example of a formula for computing the desired injection pulse width.

$$T_i = T_p \times (COEF) \times \alpha \times K_a \quad (2)$$

where COEF is a coefficient obtained by adding various correction or compensation coefficients such as coefficients of coolant temperature, full throttle open, engine load, etc., $\alpha$ is a $\lambda$ correcting coefficient (the integral of the feedback signal of the $O_2$-sensor 16), and $K_a$ is a correcting coefficient by learning (hereinafter called the learning control coefficient). Coefficients, such as the coolant temperature coefficient and engine load, are obtained by looking them up in tables in accordance with sensed information.

Figure 3A:
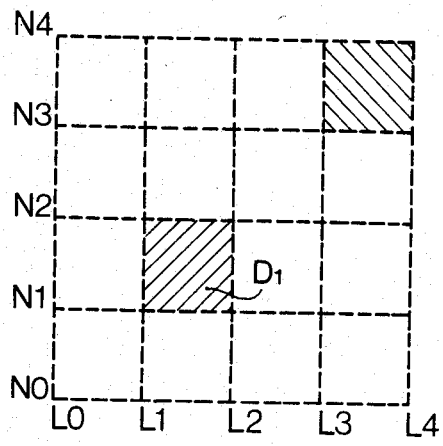
FIG. 3*a* is an illustration showing a matrix for detecting the steady state of engine operation.

The learning control coefficients $K_a$ stored in a $K_a$-table are updated with data calculated during the steady state of engine operation. In the system, the steady state is recognized by engine operating conditions in predetermined ranges of engine load and engine speed and continuation of a detected state. FIG. 3*a* shows a matrix for the detection, which comprises, for example sixteen divisions defined by five row lines and five column lines. Magnitudes of engine load are set at five points $L_0$ to $L_4$ on the X axis, and magnitudes of engine speed are set at five points $N_0$ to $N_4$ on the Y axis. Thus, the engine load is divided into four ranges, that is $L_0$–$L_1$, $L_1$–$L_2$, $L_2$–$L_3$, and $L_3$–$L_4$. Similarly, the engine speed is divided into four ranges.

Figure 4A:
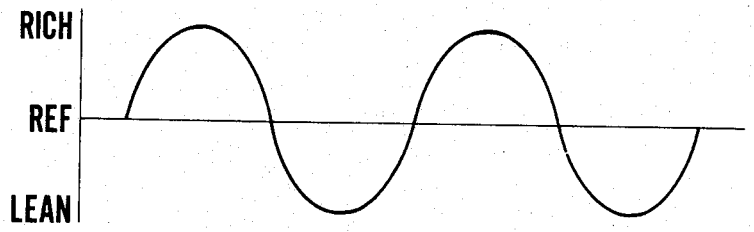
FIG. 4*a* shows the output voltage of an $O_2$-sensor.

On the other hand, the output voltage of the $O_2$-sensor 16 cyclically changes through a reference voltage corresponding to a stoichiometric air-fuel ratio, as shown in FIG. 4*a*. Namely, the voltage changes between high and low voltages corresponding to rich and lean air-fuel mixtures. In the system, when the output voltage (feedback signal) of the $O_2$-sensor continues during, for example three cycles within one of the sixteen divisions in the matrix, the engine is assumed to be in steady state.

Figure 3B:
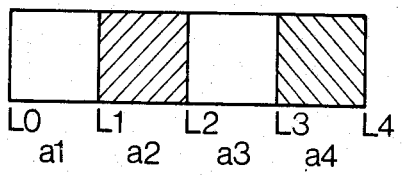
FIG. 3*b* shows a table for learning control coefficients.

FIG. 3*b* shows a $K_a$-table for storing the learning control coefficients $K_a$, which is included in the RAM 31 of FIG. 2. The $K_a$-table is a two-dimensional table and has addresses $a_1$, $a_2$, $a_3$, and $a_4$ which correspond to engine load ranges $L_0$–$L_1$, $L_1$–$L_2$, $L_2$–$L_3$, and $L_3$–$L_4$. All of the coefficients $K_a$ stored in the $K_a$-table are initially set to the same value, that is the numerical value "1". This is caused by the fact that the fuel supply system is to be designed to provide the most proper amount of fuel without the coefficient $K_a$. However, every automobile can not be manufactured to have a desired function resulting in the same results. Accordingly, the coefficients $K_a$ should be updated by experience for every automobile, when it is actually used.

Figure 4B:
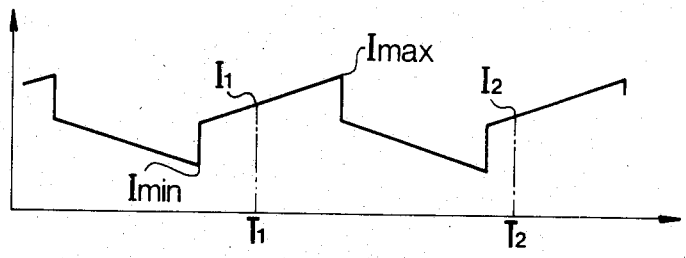
FIG. 4*b* shows the output voltage of an integrator.

Explaining the calculation of the injection pulse width ($T_i$ in formula 2) at starting of the engine, since the temperature of the body of the $O_2$-sensor 16 is low, the output voltage of the $O_2$-sensor is very low. In such a state, the system is adapted to provide "1" as the value of the correcting coefficient $\alpha$. Thus, the computer calculates the injection pulse width ($T_i$) from mass air flow (Q), engine speed (N), (COEF), $\alpha$ and $K_a$. When the engine is warmed up and the $O_2$-sensor becomes activated, the integral of the output voltage of the $O_2$-sensor at a predetermined time is provided as the value of $\alpha$. More particularly, the computer has a function of an integrator, so that the output voltage of the $O_2$-sensor is integrated. FIG. 4*b* shows the output of the integrator. The system provides values of the integration at a predetermined interval (40 ms). For example, in FIG. 4*b*, integrals $I_1$, $I_2$—at times $T_1$, $T_2$—are provided. Accordingly, the amount of fuel is controlled in accordance with the feedback signal from the $O_2$-sensor, which is represented by an integral.

Explaining the learning operation, when the steady state of engine operation is detected in one of the divisions of the matrix, data in a corresponding address of the $K_a$-table is updated with a value relative to the feedback signal from the $O_2$-sensor. The first updating is done with an arithmetical average (A) of maximum value and minimum value in one cycle of the integration, for example values of Imax and Imin of FIG. 4*b*. Thereafter, when the value of $\alpha$ is not 1, the $K_a$-table is incremented or decremented with a minimum value ($\Delta$A) which can be obtained in the computer. Namely one bit is added to or subtracted from a BCD code representing the value A of the coefficient $K_a$ which has been rewritten at the first learning.

Figure 7A:
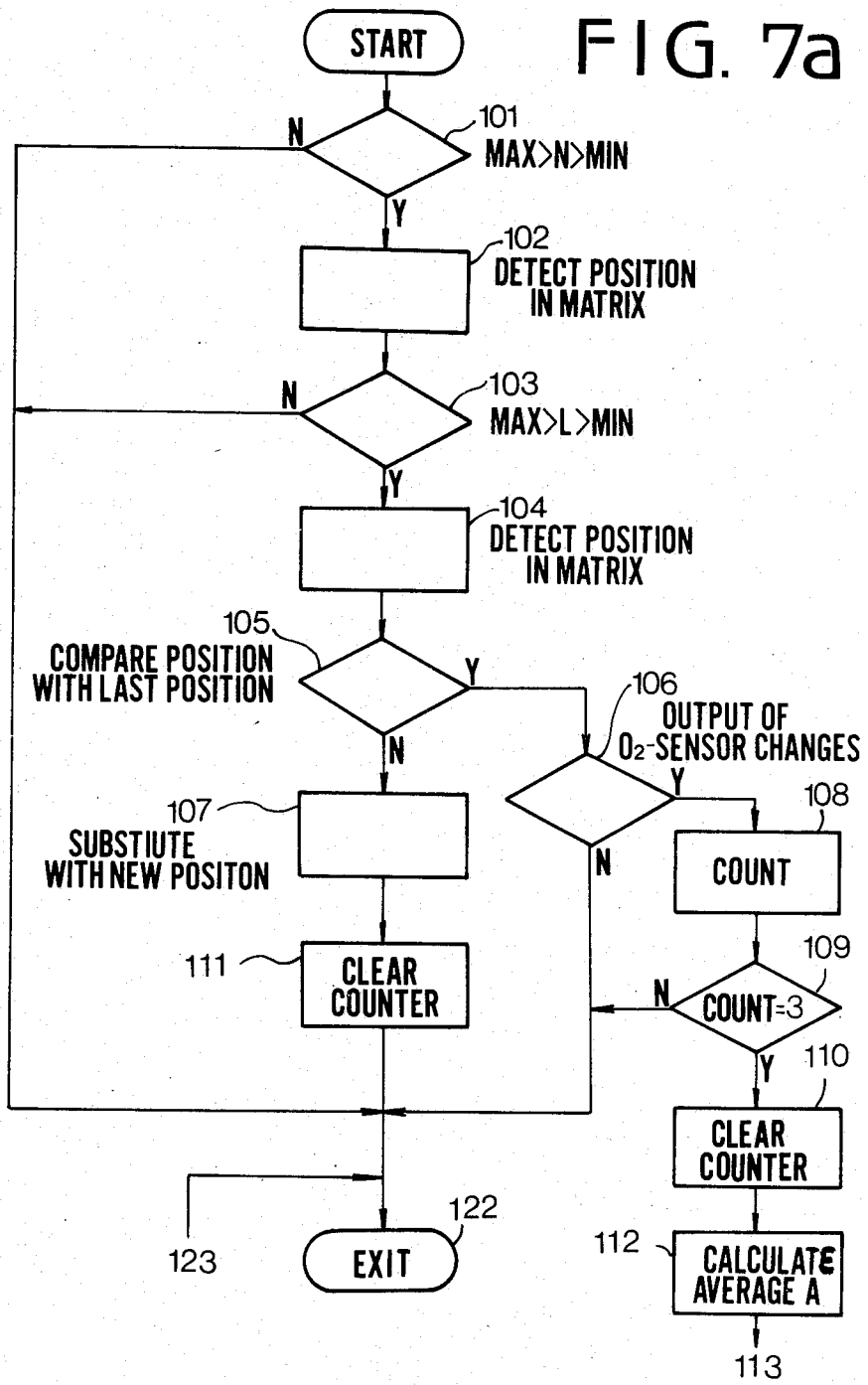
FIGS. 7*a* and 7*b* are flowcharts showing the operation in an embodiment of the present invention.
Figure 7B:
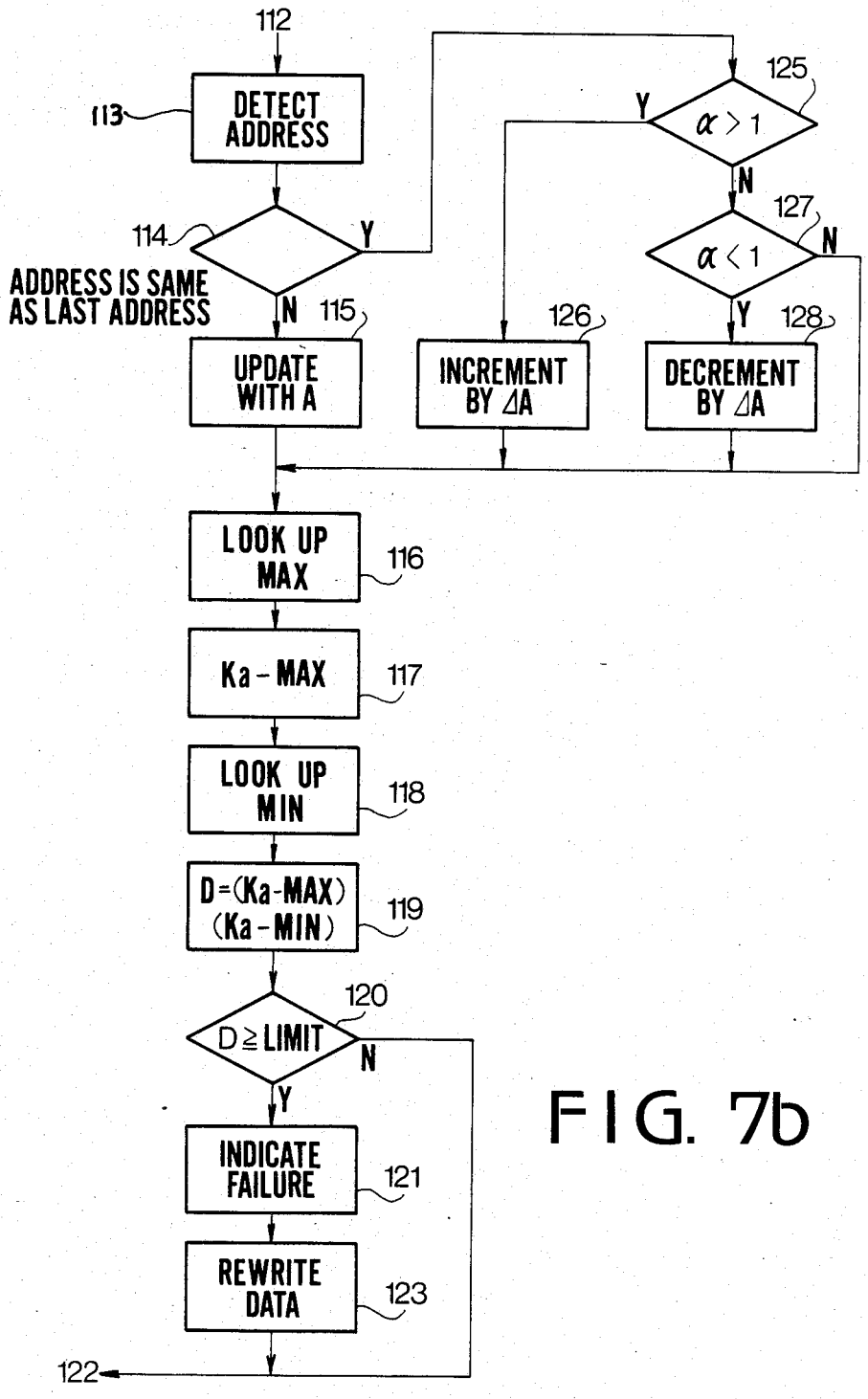

The operation of the system will be described in more detail with reference to FIG. 7. The learning program is started at a predetermined interval (40 ms). Upon the first operation of the engine and the first time the motor vehicle is driven, engine speed is detected at step 101. If the engine speed is within the range between $N_0$ and $N_4$, the program proceeds to a step 102. If the engine speed is out of the range, the program exits the routine at a step 122. At step 102, the position of the row of the matrix of FIG. 3*a* in which the detected engine speed is included is detected and the position is stored in RAM 30. Thereafter, the program proceeds to a step 103, where engine load is detected. If the engine load is within the range between $L_0$ and $L_4$, the program proceeds to a step 104. If the engine load is out of the range, the program exits the routine. Thereafter, the position of the column corresponding the detected engine load is detected in the matrix, and the position is stored in the RAM. Thus, the position of the division corresponding to the engine operating condition represented by engine speed and engine load is determined in the matrix, for example, division $D_1$ is decided in FIG. 3*a*. The program advances to a step 105, where the determined position of the division is compared with the division which has been detected at the last learning. However, since the present learning is the first, the comparison can not be performed, and hence the program is terminated passing through steps 107 and 111. At the step 107, the position of the division $D_1$ is stored in RAM 30.

At the next learning after the first learning, the then detected position is compared with the last stored position of division $D_1$ at step 105. If the position of the division in the matrix is the same as the last learning, the program proceeds to a step 106, where the output voltage of the $O_2$-sensor 16 is detected. If the voltage changes from rich to lean and vice versa, the program goes to a step 108, and if not, the program is terminated. At the step 108, the number of cycles of the output voltage is counted by a counter. If the counter counts up to, for example three, the program proceeds to a step 110 from a step 109. If the count does not reach three, the program is terminated. At the step 110, the counter is cleared and the program proceeds to a step 112.

On the other hand, if the position of the division is not the same as the last learning at the step 105, the program proceeds to step 107, where the old data of the position is substituted with the new data. At the step 111, the counter which has operated at step 108 in the last learning is cleared.

At step 112, the arithmetical average A of maximum and minimum values of the integral of the output voltage of the $O_2$-sensor at the third cycle of the output waveform is calculated and the value A is stored in the RAM. Thereafter, the program proceeds to a step 113, where the address corresponding to the position of the division is detected, for example, the address $a_2$ corresponding to the division $D_1$ is detected and the address is stored in the RAM to set a flag. At a step 114, the stored address is compared with the last stored address. Since, before the first learning, no address was stored, the program proceeds to a step 115. At step 115, the learning control coefficient $K_a$ in the address of the $K_a$-table of FIG. 3*b* is entirely updated with the new value A that is the arithmetical average obtained at step 112.

After the updating of the table, the program proceeds to a step 116, where a maximum value of the coefficients $K_a$ in the $K_a$-table is looked up and stored in a RAM (as $K_a$-Max) at a step 117. Thereafter, at a step 118, a minimum value of the coefficients $K_a$ is looked up. At a step 119, the difference between the maximum value ($k_a$-Max) and the minimum value ($k_a$-Min) is calculated to obtain a difference (D). Step 120 determines whether the difference D is greater than a predetermined limit value (LIMIT). If the difference is smaller than the limit value, the program exists the routine. Accordingly, the fuel injection pulse width is calculated by using the data stored in the $K_a$-table. If the difference D is greater than the limit value, the program proceeds to a step 121, where the failure of the $O_2$-sensor is indicated, for example by a lamp. Then, at a step 123, all of the data in the $K_a$-table are rewritten with a predetermined fail safe value, for example numerical number "1".

At the next learning after the first updating, if the address detected at the process is the same as the last address, (the flag exists in the address) the program proceeds from step 114 to a step 125, where it is determined whether the value of $\alpha$ (the integral of the output of the $O_2$-sensor) at the learning is greater than "1". If $\alpha$ is greater than "1", the program proceeds to a step 126, where the minimum unit $\Delta A$ (one bit) is added to the learning control coefficient $K_a$ in the corresponding address. If the $\alpha$ is less than "1", the program proceeds to a step 127, where it is determined whether $\alpha$ is less than "1". If $\alpha$ is less than "1", the minimum unit $\Delta A$ is subtracted from $K_a$ at a step 128. If $\alpha$ is not less than "1", which means that $\alpha$ is "1", the program exits the updating routine. Thus, the updating operation continues until the value of $\alpha$ becomes "1". The program proceeds from steps 126 and 128 to step 116, and the same programs are performed as the above described programs.

Figure 5:
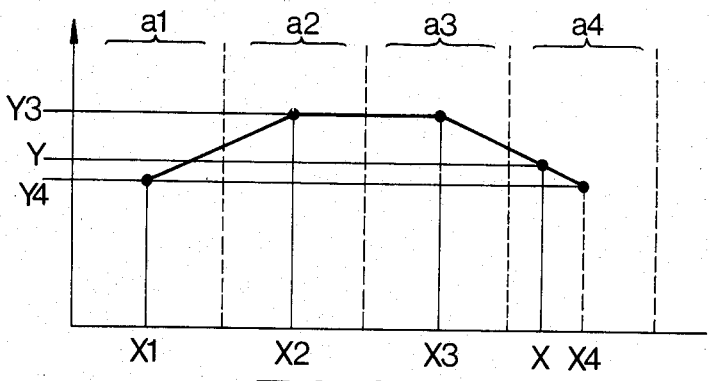
FIG. 5 shows a linear interpolation for reading the table of FIG. 3*b;*

When the injection pulse width ($T_i$) is calculated, the learning control coefficient $K_a$ is read out from the $K_a$-table in accordance with the value of engine load L. However, values of $K_a$ are stored at intervals of loads. FIG. 5 shows an interpolation of the $K_a$-table. At engine loads $X_1$, $X_2$, $X_3$, and $X_4$, updated values $Y_3$ and $Y_4$ (as coefficient K) are stored. When detected engine load does not coincide with the set loads $X_1$ to $X_4$, coefficient $K_a$ is obtained by linear interpolation. For example, value Y of $K_a$ at engine load X is obtained by the following formula.

$$Y=((X-X_3)/(X_4-X_3))\times(Y_4-Y_3)+Y_3$$

Figure 6A:
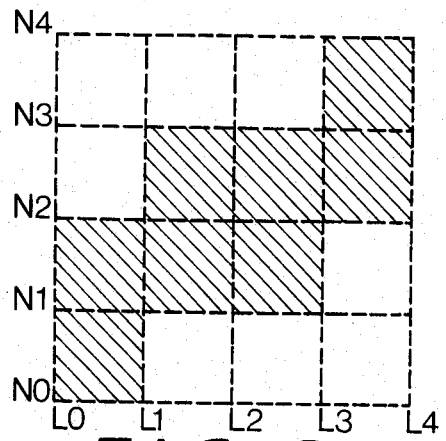
FIGS. 6*a* and 6*b* are illustrations for explaining probability of updating.
Figure 6B:
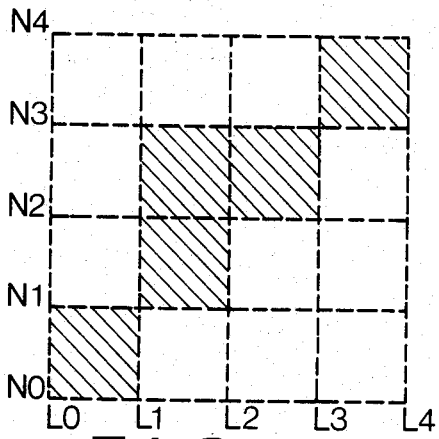

FIG. 6*a* is a matrix pattern showing the updating probability over 50% and FIG. 6*b* is a pattern showing the probability over 70% by hatching divisions in the matrix. More particularly, in the hatched range in FIG. 6*b*, the updating occurs at a probability over 70%. From the figures, it will be seen that the updating probability at extreme engine operating steady states, such as the states at low engine load at high engine speed and at high engine load at low engine speed, is very small. In addition, it is experienced that the difference between values of the coefficient $K_a$ in adjacent speed ranges is small. Accordingly, it will be understood that the two-dimensional table, in which single data is stored at each address, is sufficient for performing the learning control of an engine.

Thus, in accordance with the present invention, the failure of a sensor is detected and fail safe operation is effected to properly maintain engine operation, until the failure is repaired.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A system for controlling an automotive engine by updated data, comprising:

a table storing data which is used for controlling operation of the engine;

a sensor for detecting the operating condition of the engine and for producing a feedback signal dependent on the condition;

first means for detecting steady state of the engine operation and for producing a first signal;

second means responsive to said first signal for updating the data in the table with a value relative to the feedback signal;

third means for looking up the difference between a maximum value and a minimum value of the updated data in the table; and fourth means for rewriting all of the data in the table with a predetermined fail safe value when the difference exceeds a predetermined limit value.

2. The system according to claim 1 wherein the value relative to the feedback signal is the value of the feedback signal from the sensor.

3. The system according to claim 1 wherein the predetermined fail safe value is a numerical value 1.

4. A system for controlling an automotive engine by updated data, comprising:

a table storing data which is used for controlling operation of the engine;

first means for detecting the operating condition of the engine and for producing a feedback signal dependent on the condition;

second means for updating the data in the table with a value relative to the feedback signal;

third means for looking up the difference between a maximum value and a minimum value of the updated data in the table; and fourth means for rewriting all of the data in the table with a predetermined fail safe value when the difference exceeds a predetermined limit value.

5. The system according to claim 4, further comprising means for the controlling of the operation of the engine using said data.

* * * * *